United States Patent [19]

Amano et al.

[11] 4,089,198

[45] May 16, 1978

[54] EXTENABLE TOOL AND MACHINE HAVING THE SAME

[75] Inventors: Tadashi Amano, Machida; Susumu Kawano, Atsugi; Kenji Mano, Isehara, all of Japan

[73] Assignee: Amada Company, Ltd., Isehari, Japan

[21] Appl. No.: 699,306

[22] Filed: Jun. 24, 1976

[30] Foreign Application Priority Data

Jun. 24, 1975 Japan ..... 50-76545

[51] Int. Cl.[2] ..... B21D 37/12

[52] U.S. Cl. ..... 72/320; 72/478

[58] Field of Search ..... 72/473, 477, 478, 413, 72/411, 388, 319, 320, 322, 323, 465, 466

[56] References Cited

U.S. PATENT DOCUMENTS

| | | | |
|---|---|---|---|
| 1,721,698 | 7/1929 | Krueger | 72/319 |
| 2,302,958 | 11/1942 | Jensen | 72/319 |
| 2,564,459 | 8/1951 | Berkson | 72/319 |
| 2,729,265 | 1/1956 | Jones | 72/478 |
| 3,359,771 | 12/1967 | Meyerchick | 72/319 |

*Primary Examiner*—Michael J. Keenan

*Attorney, Agent, or Firm*—Jones, Thomas & Askew

[57] ABSTRACT

Apparatus for making folds or bends of adjustable length in sheet metal. The apparatus includes a retractable chain-like die which can be shortened or lengthened so as to adjust the operative length of the die.

7 Claims, 12 Drawing Figures

EXTENABLE TOOL AND MACHINE HAVING THE SAME

BACKGROUND OF THE INVENTION

1. Field of the Invention

The present invention relates generally to tools for metal processing machines and more particularly to tools or dies for folding and bending machines for folding or bending sheet metals.

2. Description of the Prior Art

In many industries, there exists a requirement to frequently make various bends of diverse lengths on sheet metals in small quantities. Accordingly, it is very often necessary to change or adjust tools or dies on folding or bending machines depending upon the lengths of bends to be made on sheet metals.

Heretofore, it has been a customary practice in the processing of sheet metals to prepare many tools of diverse lengths for a folding or bending machine and change or adjust the whole length of tools on the machine depending upon the lengths of bends to be made on sheet metals by changing the tools or combining several tools of different lengths.

It has been however very troublesome and time-consuming to obtain a desired length of tools in the customary manner. Each time when it is desired to change the length of the tools, it has been necessary to select tools forming a desired length from among many tools of diverse lengths and then change heavy tools on the machine.

Furthermore, it has been impossible to satisfactorily obtain all desired lengths of tools in the conventional manner, since it is impossible to completely prepare all lengths of tools.

SUMMARY OF THE INVENTION

It is an object of the present invention to provide a versatile tool or die for folding and bending machines which can be adjusted to any desired length depending upon the length of bends to be made on sheet metals.

It is another object of the present invention to provide a convenient tool or die for folding and bending machines which can be very easily adjusted to any desired lengths depending upon lengths of bends to be made on sheet metals.

It is a further object of the present invention to provide a folding or bending machine in which a tool or die can be easily adjusted to any desired lengths.

Basically, the method of the present invention employs a fixed die, a movable and a retractable chain-like die which are designed to act as an integral die as a whole.

Other and further objects and advantages of the present invention will be apparent from the following description and accompanying drawings which, by way of illustration, show a preferred embodiment of the present invention and the principle thereof.

DESCRIPTION OF THE PREFERRED EMBODIMENTS

Referring now to the accompanying drawings, the present invention has been illustrated in connection with a so-called folding machine. It will be understood, however, that the invention is not limited in application to so-called folding machines but is also applicable to bending machines or presses which are identified in the art as press brakes.

Figure 2:
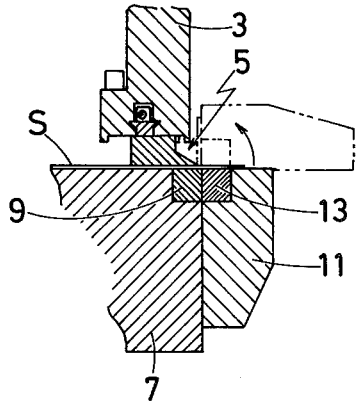
FIG. 2 is a schematic side view of the folding machine shown in FIG. 1.
Figure 5:
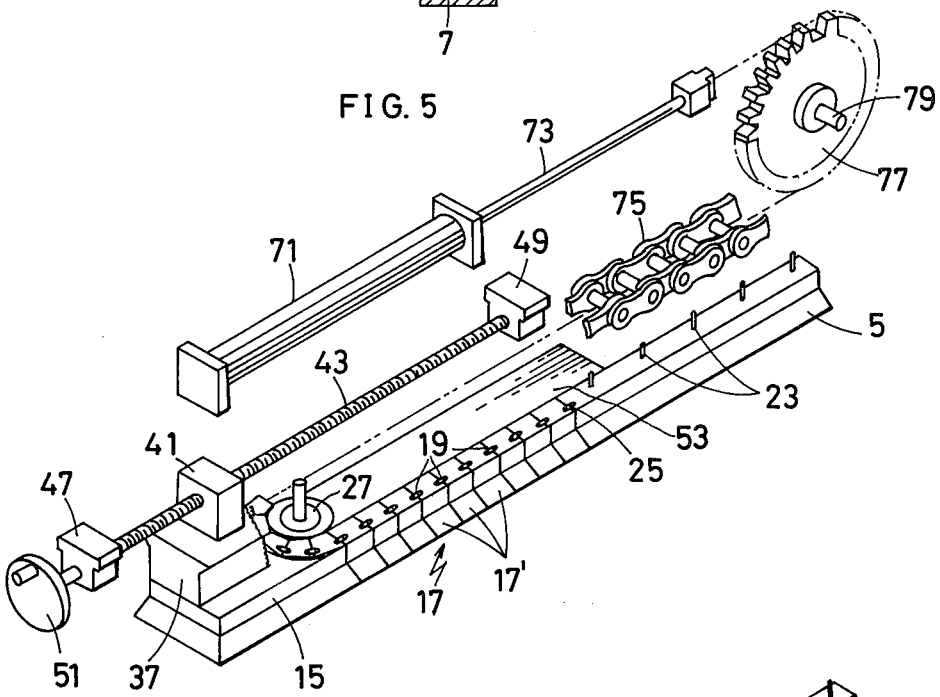
FIG. 5 is an isometric view illustrating major portions of the apparatus according to the present invention with parts broken away for clarity.

The folding machine generally designated by the numeral 1 in the drawings is conventional in that it has a substantially rectangular ram 3 having an upper die 5 horizontally fixed at the front underside thereof, a table 7 having an elongate lower die 9 horizontally fixed at the front top thereof and a bending beam 11 having an elongate folding die 13 horizontally fixed at the top thereof. The ram 3 is movable towards and away from the table 7 along a suitable guide means by a suitable driving means such as a hydraulic motor, and the bending beam 11 is swingable from its horizontal position towards the front face of the ram 3 around horizontally disposed hinge pins. Thus, in folding operation, the ram 3 is initially lowered to enable the upper fixed die 5 to press and clamp the sheet metal or work-sheet S in cooperation with the lower die 9 and then the bending beam 11 is swung around its pivotal hinge pins with the folding die 13 to fold the free end of the work-sheet S as shown in FIG. 2.

According to the present invention, the upper die mounted on the bottom of the ram 3 comprises, in addition to the above described fixed die 5, a movable die 15 of a longish block and a retractable chain-like die 17 which comprises a plurality of die pieces 17' pivotally connected with each other by links 19 and link pins 21 in a manner to be detailedly described later. As seen from the drawings, the fixed die 5 is fixedly secured by bolts 23 to the underside of the ram 3 to extent from one end thereof, and the retractable chain-like die 17 is connected with the end of the fixed die 5 by a link means 25 and also the movable die 15 is mounted in connection with the retractable chain-like die 17. These three upper dies 5, 15 and 17 are so aligned as to form a straight row and serve as an integral upper die as a whole.

It is the most important feature of the present invention that the upper die can be expanded or contracted depending upon the widths of the bends to be formed on the work-sheet S, and for this purpose the retractable chain-like die 17 is so designed as to be expanded and contracted and also the movable die 15 is horizontally movable according to the expansion and contraction of the chain-like die 17.

Figure 11:
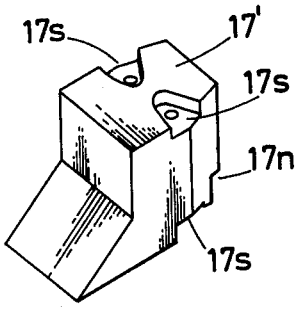
FIG. 11 is a perspective view of an element of the apparatus according to the present invention.
Figure 12:
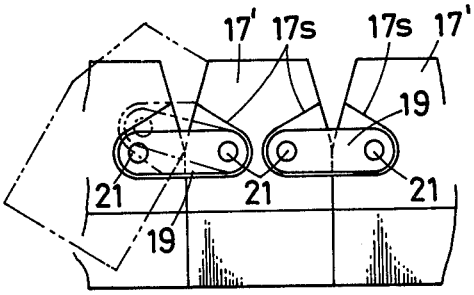
FIG. 12 is a plan view of the element shown in FIG. 11 and related elements.

As best shown in FIGS. 11 and 12, each of the die pieces 17' of the retractable chain-like die 17 has its inner portion tapered from a vertical plane where the pins 21 of the connecting links 19 are located. Also, the links 19 are pivoted on the pins 21 in concave shoulders **17*s* formed at the opposite shoulders of the die pieces 17' and such concave shoulders 17*s* are formed to be of a sector or fan-shaped in a horizontal section. The concave shoulders 17*s* are formed also at the opposite bottom shoulders of each die piece 17' and there are provided the same links 19 and pines 21. Thus, each of the die pieces 17' of the retractable chain-like die 17 can be turned inwardly (upwardly as viewed in FIG. 12) as shown by the phantom lines in FIG. 12 and therefore the chain-like retractable die 17 can be led or retracted inwardly. Also, each of the die pieces 17' is provided at its inner bottom with a rectangular notch 17*n*** for a purpose to be seen later.

From the above description, it will now be understood that the retractable chain-like die 17 can be shortened or lengthened by turning inwardly or returning outwardly the die pieces 17' so as to adjust the whole length of the upper die.

The end of the retractable chain-like die 17 is trained around a wheel 27 located under the ram 3 and is resiliently drawn by a suitable means to be described later. The wheel 27 is provided at its undermost periphery with a flange 29 on which the rectangular notches **17*n* of the die pieces 17' of the retractable chain-like die 17 are slidable, and also the wheel 27 is rotatably mounted by means of bearings 31 and 33 on a shaft 35 which is vertically secured to a long dovetail carrier means 37**.

The dovetail carrier means 37 is horizontally movably supported in a dovetail groove 39 which is horizontally formed at the bottom of the ram 3. The dovetail carrier means 37 is provided at its top surface with a nut or screwed member 41 with which a horizontal lead screw 43 engages. The screwed member 41 and the lead screws 43 are located in a horizontal long channel-like groove 45 which is formed at the bottom of the ram 3 above and along the dovetaill groove 39. The lead screw 43 is rotatably supported by support members 47 and 49 which are fixedly secured in the channel-like groove 45 to the ram 3. Also, the lead screw 43 is provided at its projecting end with a handwheel 51. Thus, it will be understood that the dovetail carrier means 37 can be horizontally moved along the dovetail groove 39 by rotating the handwheel 51. Accordingly, the wheel 27 pivoted to the dovetail carrier means 37 can be also horizontally moved along the bottom of the ram 3 by rotating the handwheel 51.

The movable die 15 is also secured to the dovetail carrier means 37 in a suitable manner so that it will be horizontally moved together with the wheel 27 when the handwheel 51 is rotated. In the preferred embodiments, as shown in FIGS. 4 and 6, the movable die 15 is designed to enclose the round front portion of the retractable chain-like die 17 trained around the wheel 27, and accordingly the end of the movable die 15 adjacent to the wheel 27 is formed to have an arcuate horizontal section.

Figure 4:
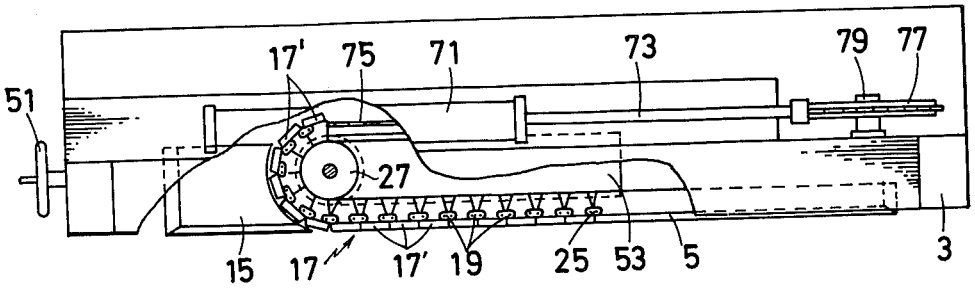
FIG. 4 is a plan view of the folding machine shown in FIG. 1 with parts broken away for clarity.
Figure 6:
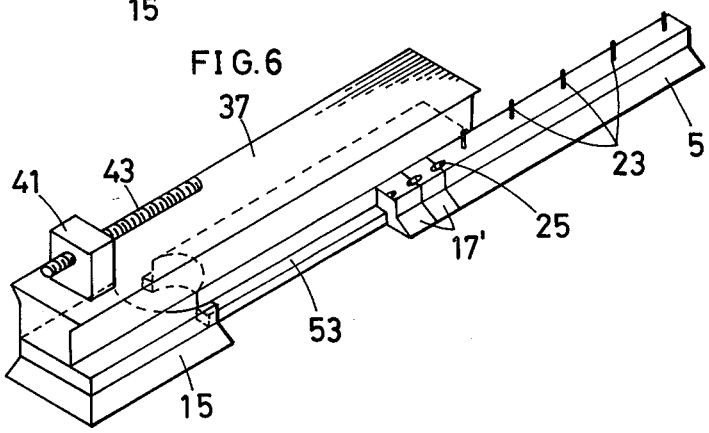
FIG. 6 is an isometric view showing the same as those shown in FIG. 5 with parts broken away for clarity.
Figure 7:
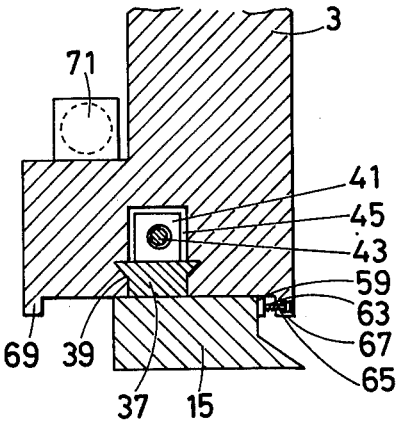
FIG. 7 is a sectional view taken along the line VII—VII of FIG. 3.
Figure 9:
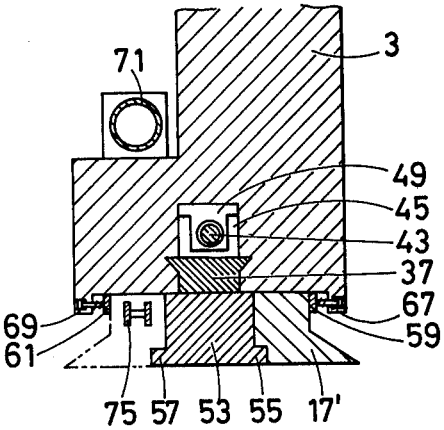
FIG. 9 is a sectional view taken along the line IX—IX of FIG. 3.
Figure 10:
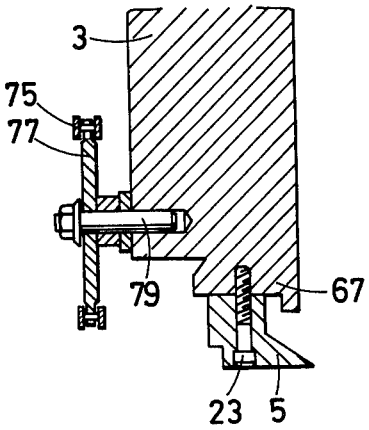
FIG. 10 is a sectional view taken along the line X—X of FIG. 3.

As best shown in FIGS. 4, 6 and 9, a holding means 53 for holding the chain-like die 17 is secured to the dovetail carrier means 37 in a suitable manner so that it may be horizontally moved together with the wheel 27 and the movable die 15. This holding means 53 is of a long square block having the same width as the diameter of the wheel 27, but it is provided at its lowermost sides with elongate flanges 55 and 57 on which the rectangular notches **17*n* formed at the lowermost backs of the die pieces 17' of the chain-like die 17 are designed to sit and slide. The end of the holding means 53 is formed to have an arcuate horizontal section where the wheel 27 is rotatable. It will be understood that the retractable chain-like die 17 is held and guided by the holding means 53 and the wheel 27 and their flanges 55, 57 and 29**.

Figure 1:
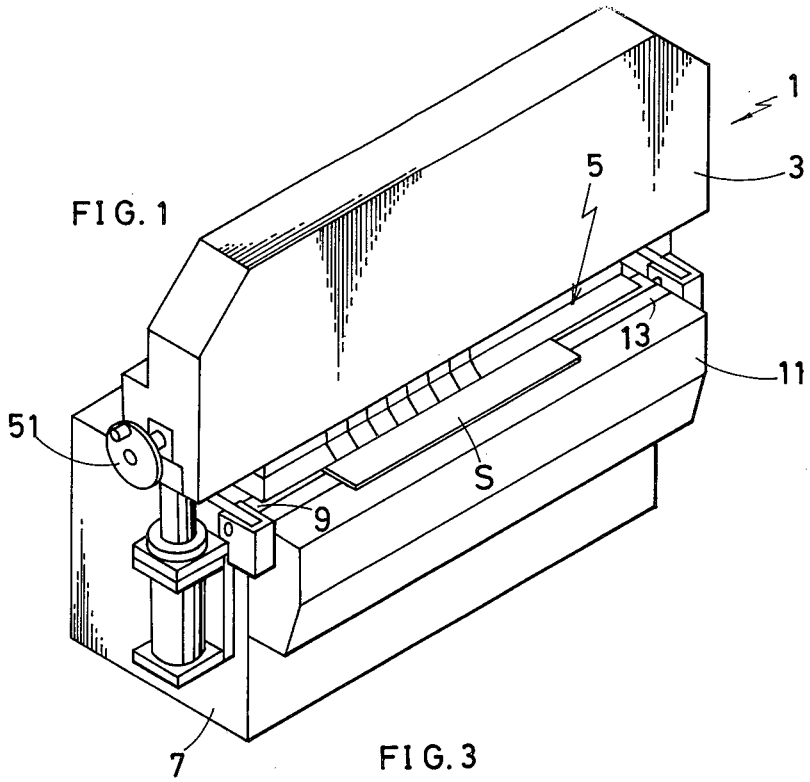
FIG. 1 is an isometric view showing a folding machine incorporating the apparatus according to the present invention which, for the purpose of clarity, has not necessarily been shown as strictly coinciding with corresponding portions shown in other figures.
Figure 3:
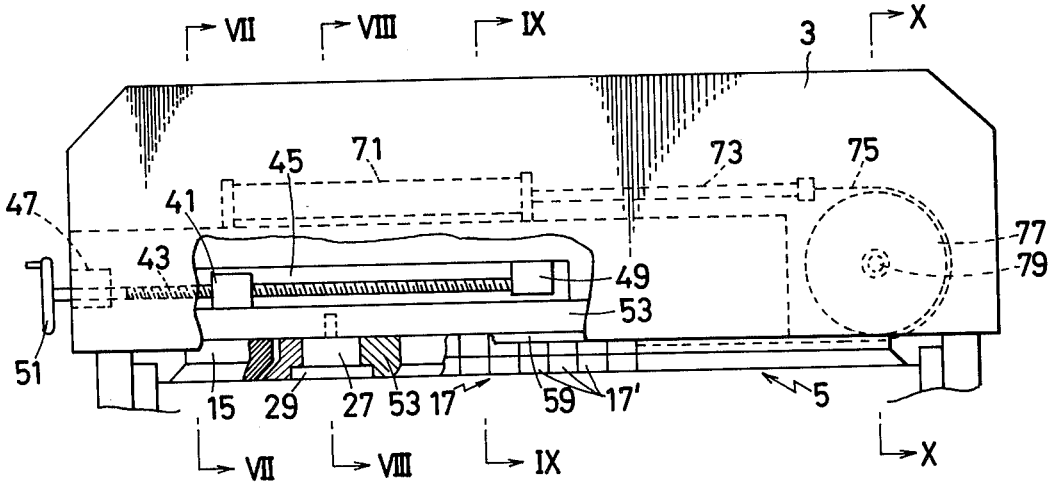
FIG. 3 is a front elevational view showing the upper portion of the folding machine shown in FIG. 1 with parts broken away for clarity.
Figure 8:
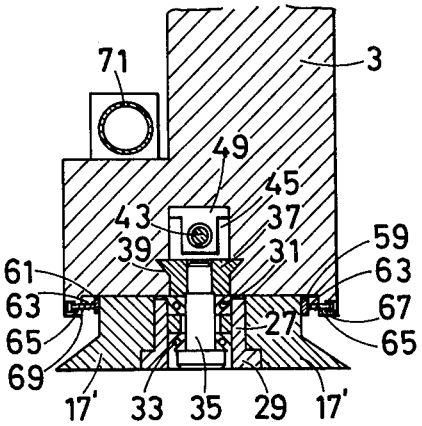
FIG. 8 is a sectional view taken along the line VIII—VIII of FIG. 3.

As shown in FIGS. 3, 8 and 9, horizontal elongate plates 59 and 61 are biased against the upper portion of the chain-like die 17 by a plurality of springs 63 to bias the chain-like die 17 against the holding means 53 and the wheel 27 so as to hold the same on the flanges 55, 57 and 29 of the holding means 53 and the wheel 27. The plates 59 and 61 are supported by means of a plurality of pins 65 by horizontal elongate flanges 67 and 69 which are provided on the bottom of the ram 3. The pins 65 supporting the plates 59 and 61 are horizontally and loosely supported in horizontal bores formed through the flanges 67 and 69 of the ram 3 and are enclosed by the springs 63. Thus, it will now be understood that the chain-like retractable die 17 is held between the holding means 53 and the plates 59 and 61 but can be slidable therebetween.

The end of the retractable chain-like die 17 is resiliently drawn or biased by a suitable means. In the preferred embodiments, the end of the chain-like die 17 is drawn by a hydraulic motor 71 having a piston rod 73 which is secured to a portion of the ram 3 in a suitable manner. As best shown in FIG. 4, the end of the retractable chain-like die 17 is connected with the piston rod 73 of the hydraulic motor 71 by a chain 75 through a sprocket 77 which is rotatably supported on a portion of the ram 3 by means of a horizontal shaft 79. The hydraulic motor 71 is so designed as to always draw the retractable chain-like die 17 resiliently but nevertheless allow the piston rod 73 to extend when forced.

From the above description, it will now be apparent that the chain-like die 17 can be lengthened and shortened along the holding means 53 by rotating the handwheel 51. When the handwheel 51 is rotated, the lead screw 43 moves horizontally the dovetail carrier means 37 along the dovetail groove 39 and accordingly the slidable die 17, the wheel 27 and the holding means 53 are also horizontally moved together. When the wheel 27 is moved leftwards as viewed in the drawings, the chain-like die 17 is drawn in the same direction by the wheel 27 against the hydraulic motor 71 and accordingly the exposed portion of the chain-like die 17 will become long. To the contrary, when the wheel 27 is moved rightwards as viewed in the drawings, the end of the chain-like die 17 is drawn and moved in the same direction by the hydraulic motor 71 along the holding means 53 and accordingly it is retracted around a wheel 27 and as the result the exposed portion of the chain-like die 17 will be shortened. Thus, the whole length formed by the movable die 15, the chain-like die 17 and the fixed die 5 is lengthened or shortened when the handwheel 17 is rotated.

As has been so far described, according to the present invention, it is only necessary to rotate the handwheel 51 in order to change the length of the tools or dies depending upon the lengths of the bends to be made on sheet metals. Accordingly, the length of the tools can be very easily and quickly adjusted or changed.

Although a preferred form of the present invention has been illustrated and described, it should be understood that the device is capable of modification by one skilled in the art without departing from the principles of the invention. Accordingly, the scope of the invention is to be limited only by the claims appended hereto.

We claim:

1. A metal processing apparatus comprising a fixed tool means, a retractable chain-like tool means pivotally connected with said fixed tool means; a movable tool means mounted in connection with said retractable chain-like tool means, said fixed, chain-like, and movable tool means being aligned to form a straight row and said retractable chain-like tool means comprising a plurality of tool pieces pivotally connected with each other by link means; and means for folding said metal about said aligned fixed, chain-like, and movable tool means.

2. An apparatus as claimed in claim 1 wherein said retractable chain-like tool means is trained around a rotatable wheel and is resiliently drawn by a resiliently drawing means said wheel means is movable with the said movable tool means.

3. An apparatus as claimed in claim 2 wherein said movable tool means and said wheel means are carried by a movable carrier means.

4. An apparatus as claimed in claim 3 wherein said carrier means is movable by a lead screw means.

5. A metal processing apparatus comprising:

means for providing a die about which a sheet of material may be folded;

said die means including a fixed tool means, a retractable chain-like tool means pivotally connected with said fixed tool means and a movable tool means mounted in connection with said retractable chain-like tool means, said fixed, chain-like, and movable tool means being aligned to form a straight row and said retractable chain-like means comprising a plurality of tool pieces pivotally connected by link means;

means for carrying said die means;

means for holding said sheet of material firmly against said die means; and means for folding said material about said die means.

6. A metal processing apparatus comprising:

a die;

means for supporting said die;

means for selectively increasing or decreasing the length of said die including a movable carrier;

a solid die portion having a convex arcuate end fixed to and movable with said carrier;

a wheel rotatable about an axle fixed to said carrier opposite said arcuate end of said solid die portion and movable with said carrier;

a chain-like die portion fixed at one of its ends to said support means and passing around said wheel between said wheel and said arcuate end of said solid die portion;

means for maintaining tension on the other of the ends of said chain-like die portion;

means for moving said carrier whereby the length of said chain-like die portion between said wheel and the end of said chain-like die portion fixed to said support means may be selectively varied; and means for folding said metal about said aligned fixed, chain-link, and movable tool means.

7. A metal processing apparatus comprising:

a metal working member comprising a length of flexible die about which a sheet of metal may be folded;

means for selectively increasing or decreasing the length of said flexible die;

means for carrying said metal working member;

means for holding said sheet of metal firmly against said metal working member; and means for folding said sheet of metal about said metal working member.

* * * * *